US005664737A

United States Patent [19]

Johnson et al.

[11] Patent Number: 5,664,737

[45] Date of Patent: Sep. 9, 1997

[54] CENTERWIND ASSIST FOR A PAPER WINDER SYSTEM

[75] Inventors: Noel R. Johnson, Stoughton; David A. Smith, Beloit, both of Wis.

[73] Assignee: Beloit Technologies, Inc., Wilmington, Del.

[21] Appl. No.: 541,447

[22] Filed: Oct. 10, 1995

[51] Int. Cl.[6] ..... B65H 18/10; B65H 18/16

[52] U.S. Cl. ..... 242/541.1; 242/542.3; 242/545; 242/534; 242/596.1

[58] Field of Search ..... 242/541.1, 541.4, 242/542.3, 545, 545.1, 534, 596.1, 596.3

[56] References Cited

U.S. PATENT DOCUMENTS

| | | | |
|---|---|---|---|
| 2,392,148 | 1/1946 | Hornbostel | 242/541.1 |
| 2,475,480 | 7/1949 | Clem et al. | 242/541.1 |
| 3,614,011 | 10/1971 | Karr . | |
| 3,743,199 | 7/1973 | Karr et al. . | |
| 3,857,524 | 12/1974 | Melead et al. . | |
| 3,889,892 | 6/1975 | Melead . | |
| 4,552,317 | 11/1985 | Halter | 242/541.7 |
| 5,069,394 | 12/1991 | Panttila et al. . | |
| 5,083,719 | 1/1992 | Kremar . | |
| 5,184,787 | 2/1993 | Holzinger et al. . | |
| 5,251,835 | 10/1993 | Kyytsonen | 242/541.1 |
| 5,299,751 | 4/1994 | Pichlmair et al. | 242/534 |
| 5,370,327 | 12/1994 | Adamski . | |
| 5,375,790 | 12/1994 | Suanqvist | 242/541.1 |
| 5,377,931 | 1/1995 | Dorfel et al. . | |
| 5,520,354 | 5/1996 | Adamski | 242/541.1 |
| 5,544,841 | 8/1996 | Didier et al. | 242/541.1 |

FOREIGN PATENT DOCUMENTS

| | | | |
|---|---|---|---|
| 0 483 093 A1 | 10/1991 | European Pat. Off. . | |
| WO-A1-9306033 | 4/1993 | WIPO . | |
| WO-A1-9306034 | 4/1993 | WIPO . | |
| 9424033 | 10/1994 | WIPO | 242/541.1 |
| WO-A1-9615059 | 5/1996 | WIPO . | |

OTHER PUBLICATIONS

Tulokas, Jouni and Kyytsonen, Markku "The New Optireel for Better Paer Reeling", 79th Annual Meeting, Technical Section CPPA (undated).

Renvall, Stig "Improved Reel Structure with Optireel Reduces Amounts of Broke and Gives Better Roll Quality" —8 pages (undated).

Beloit brochure entitled: "Partners in Productivity", vol. 2, No. 2.

Beloit advertising brochure entitled: "Beloit Reels For All Grades of Paper and Board. . . Operate Over a Board Range of Widths and Speeds", Beloit No. B–309 (printed on the lower left corner of last page).

Beloit brochure entitled: "Beloit Reels For All Grades of Paper and Board To Be Rolls Up to 100 widths and more than 120" diameter at speeds up to 6,000 fpm., Beloit Brochure No. B–158B.

Beloit Papermaking Technology "Beloit TNT Reel —A New Reel for Today and Tomorrow's Paper Machines" —Brochure.

*Primary Examiner*—John M. Jillions

*Attorney, Agent, or Firm*—Dirk J. Veneman; Raymond W. Campbell; Gerald A. Mathews

[57] ABSTRACT

A drive shaft is moved in a machine direction and a cross-machine direction to engage a spool on a winder. The drive shaft has an inner drive shaft which is elastically linked to an outer cylindrical shell, thereby allowing misalignment between the inner shaft and the outer shell and allows angular as well as horizontal and vertical displacement when the drive head engages the spool to provide centerwind assist to a roll of paper being formed thereon. The location of the drive shaft axis is determined at all times from geometric considerations and this data is used to position the drive shaft on the axis of the winding spool.

18 Claims, 4 Drawing Sheets

CENTERWIND ASSIST FOR A PAPER WINDER SYSTEM

FIELD OF THE INVENTION

The present invention relates to equipment for forming and handling rolls of paper in general and to paper winder systems for collecting and removing paper from a papermaking machine in particular.

BACKGROUND OF THE INVENTION

Paper is manufactured as a continuous web formed on a papermaking machine. A paper web is formed at the so-called wet end of a papermaking machine by depositing a slurry of paper fibers and water onto a moving screen. The mat of fibers on the screen is first dewatered. The mat of fibers thus formed still consists primarily of water which is removed through progressive stages of pressing followed by drying on heated dryer rolls. The dried paper web may then be smoothed by passage through a calender or supercalender which compresses the web between opposed rollers and improves the surface finish and uniformity of paper thickness.

All the processes involved in papermaking, from the forming of the paper at the wet end to calendering at the dry end, are continuous in nature. However, the final step of the papermaking process, that of winding or reeling the paper web onto spools for removal from the paper machine, is an inherently discontinuous process and can result in non-uniform treatment of the paper web.

The reel of paper typically formed on a modern papermaking machine may have a diameter of 120 inches or more and a reel width of 200 to 400 inches. The paper on the so-called machine or jumbo reels is typically further processed by rewinding and slicing and sometimes coating the paper to form individual reels or sets to be used by paper-consuming customers such as newspapers. Studies performed in the past few years have shown that a paper web formed into the jumbo or machine reel can become damaged. The damage typically is in the form of tears near the edge of the sheet or creasing near the center. The damage typically results in the paper web breaking when it is further processed in a paper coating or rewinding machine or is utilized in a newspaper web press.

A set is a smaller roll of paper which has been formed from a jumbo reel. The last set is paper which is nearest the center of the original jumbo reel, that is the paper first wound onto the jumbo reel spool. Studies have shown that at some paper mills, as high as 70 to 80 percent of all rejects on critical paper grades are from the last set off the reel. In one study, 73 percent of the press room paper web breaks during printing were in the last set off the reel.

With increased papermaking speed and web widths, the size and weight of wound jumbos has also increased. In the past a certain percentage loss of paper due to reel defects was considered acceptable. However, with an increase in size of machine rolls, the problems associated with existing paper reels have been exacerbated while at the same time tolerance of product defects or waste of any kind has decreased due to increased competitive pressures and concern for maximum efficiency in the utilization of natural resources.

The solution to defects in the machine or jumbo reel is to produce a more uniformly wrapped paper web on the reel. The tightness or quality of the reel wrap depends on three factors: Tension, Nip pressure (including reel support for uniformity of nip pressure), and Torque. A paper winder employs a reel drum which is driven by the paper machine drive at a speed selected to impart a proper amount of tension. The tension is selected for a given grade and strength of paper and is typically 10–25 percent of the tensile strength of the given grade of paper. The web spool and the reel of paper built up thereon rides against the reel drum forming a nip therebetween. The nip compresses the paper which is wound onto the core. At the same time, at least initially, the reel drum may supply some support during initial winding for the reel.

Tension may be controlled by a centerwind assist drive which drives the machine reel. The centerwind assist is a differential torque drive with a differential torque controller controlling the amount of tension introduced into the web between the reel drum and the machine reel as it is built up on the core. German Application Number 91850261.8 entitled "Reel-up and Method for Regulation of the Nip Pressure in a Reel-up", corresponding to English language European Patent Application published as No. 0 483 093 A1, discloses a reel system which addresses some of the foregoing problems in the reel. The German Application discloses employing a tilting rail which is pivoted about the axis of rotation of the reel drum. Riding on the rail is the core, or reel spool, of the reel upon which the paper web is wound. The German Application discloses varying the angle between the rails and the horizontal such that the load of the nip formed between the machine reel and the reel drum remains uniform as the web is wound onto the machine reel.

Another type of winder system is the TNT System produced by Beloit Corporation which employs continuous control of the tension, nip and torque to produce machine reels of uniform density which are substantially less susceptible to the problems discussed herein. The Beloit TNT machine employs a horizontal rail located above a reel drum. The reel drum is vertically positionable and is controlled in response to a load cell which directly measures the nip pressure. The Beloit TNT machine solves the problems outlined above and produces a machine roll of uniform structure with minimal winder induced defects. Although the Beloit TNT machine provides a satisfactory solution to producing jumbo machine rolls of excellent uniformity, other approaches to the same problem are desirable. The papermaking industry has a large base of installed machinery of many differing makes and ages which are utilized to make a wide variety of papers and paper boards.

While completely new winder designs are proving effective at overcoming defects produced by winding a paper web onto a jumbo reel, there exists a large installed base of conventional Pope-type reels. In this type of reel a first arm positioned over a drive roll receives a spool. The first arm brings the spool into engagement with the drive drum where wrapping of the paper web is initiated. As the web is wrapped onto the roll, the first arm moves the spool down onto a pair of parallel rails which extend approximately parallel to the axis of the drive drum. The paper web is continuously wound onto the spool while it is held in engagement with the drive drum by a second arm. Such winders are exemplified, for example, in U.S. Pat. Nos. 3,743,199 to Carr et al and 3,857,524 to Melead et al. The Pope style winder controls the nip pressure between the reel and the winder drum through mechanisms which utilize the second winder arm to urge the reel against the winder drum. The need to improve uniformity of the paper wound onto reels requires attention to all three of the parameters influencing the wound roll uniformity and structure, namely the torque applied to the spool/core, the linear nip pressure between the wound web roll and the support drum, and the tension in the oncoming web being wound onto the roll.

Existing reels or winders control mainly the nip pressure between the wound web roll and the support drum. The employment of a centerwind assist drive in a conventional Pope style winder is difficult because the path taken by the spool/core from the first arm over the drum to the second arm and along the support rails is a path which experiences abrupt changes. This path complexity exacerbates or even causes the non-uniformity in the wound web, and makes it difficult to connect the centerwind assist drive in driving relation to the core as the paper web is built up on the core.

What is needed is a centerwind assist drive which can be employed with a conventional Pope style winder to improve the quality of the paper reels formed thereon.

SUMMARY OF THE INVENTION

The centerwind assist drive of this invention employs a drive motor and gear box mounted on a first carriage. The first carriage is mounted to a series of linear guide rails for motion in the cross-machine direction. The first carriage is mounted on a second carriage which is mounted on linear guide rails for motion in the machine direction. A drive shaft is mounted on a movable arm which is mounted to the first carriage. A drive belt extends between the output of a gear box and the drive shaft, and drives a hollow cylindrical shell which is rotatably mounted to the drive arm. The drive shaft is composed of the outer cylindrical drive shell and an inner drive shaft. The inner drive shaft has a drive head at one end and an elastic drive link at the other end which connects the inner drive shaft to the outer drive shell but which allows some misalignment between the inner drive shaft and the outer drive shell. There is a compliant linkage between the inner drive shaft and the drive head which allows angular as well as horizontal and vertical displacement between the inner drive shaft and the drive head. The drive head engages the spool to provide centerwind assist to the roll of paper being formed on the spool. The location of the axis of the driven spool is determined at all times from geometric considerations based on the angular position of the first spool arm, the diameter and speed of the winder drive roll, the height of the reel support rails, the location of the driven spool on the reel support rails, and the angular velocity of the paper being formed on the spool.

With the knowledge thus derived and the position of the axis of the drive spool, the centerwind assist shaft is positioned by controlling the angular position of the drive shaft arm and the linear position of the second carriage and its motion on its sliding rails in the machine direction.

It is a feature of the present invention to provide a centerwind assist drive for a Pope style winder.

It is another feature of the present invention to provide a centerwind assist drive which is driven to the calculated position of the axis of a spool on which a paper web is being wound.

It is a further feature of the present invention to provide a means for improving the quality of a wound web of paper on a paper roll.

It is a further feature of the present invention to provide a centerwind assist drive which can accommodate misalignments in displacement and angular relationship between a drive shaft and a reel.

Further objects, features and advantages of the invention will be apparent from the following detailed description when taken in conjunction with the accompanying drawings.

DESCRIPTION OF THE PREFERRED EMBODIMENT

Figure 1:
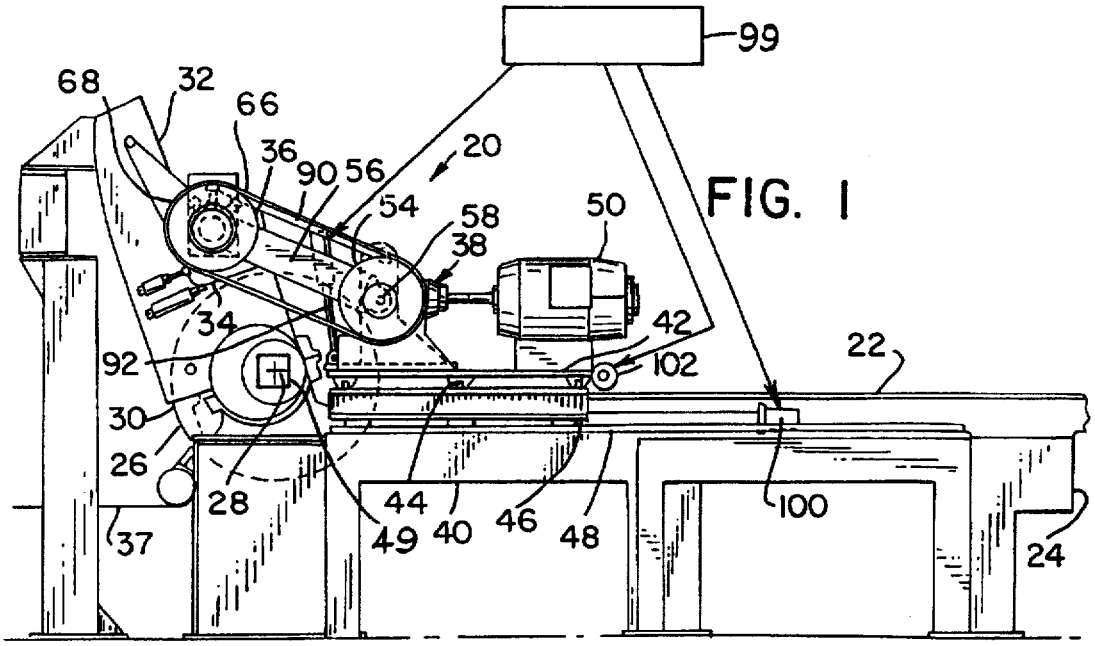
FIG. 1 is a side-elevational view of the centerwind assist drive of this invention engaging a spool as it is brought into engagement with a winding drum on a winder.
Figure 2:
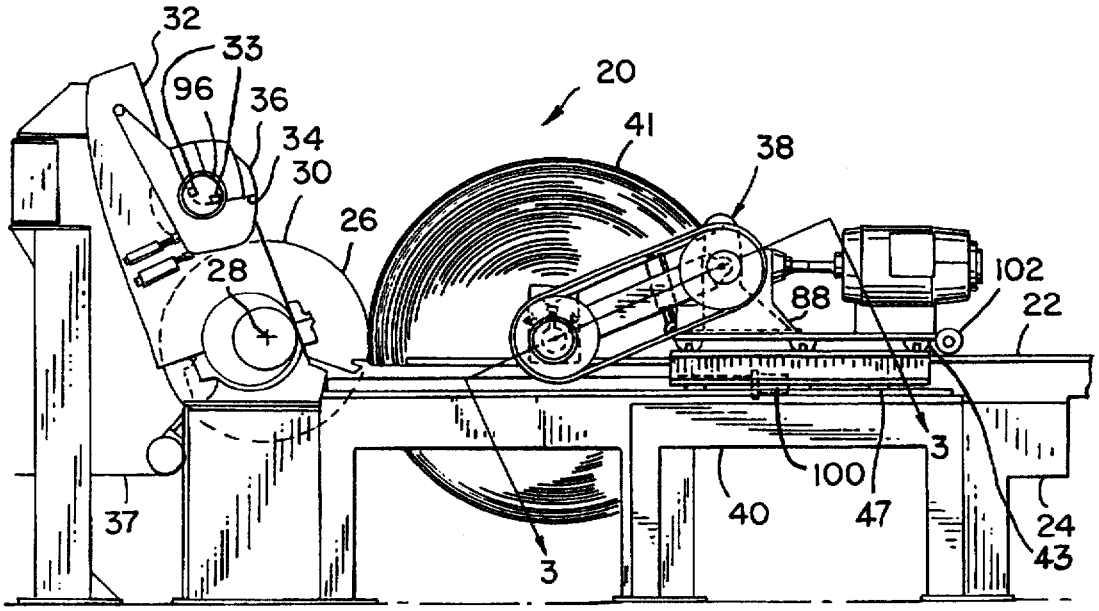
FIG. 2 is a side-elevational view of the winder and the centerwind assist drive of FIG. 1 with a reel of paper nearly completely formed on the winder.
Figure 3:
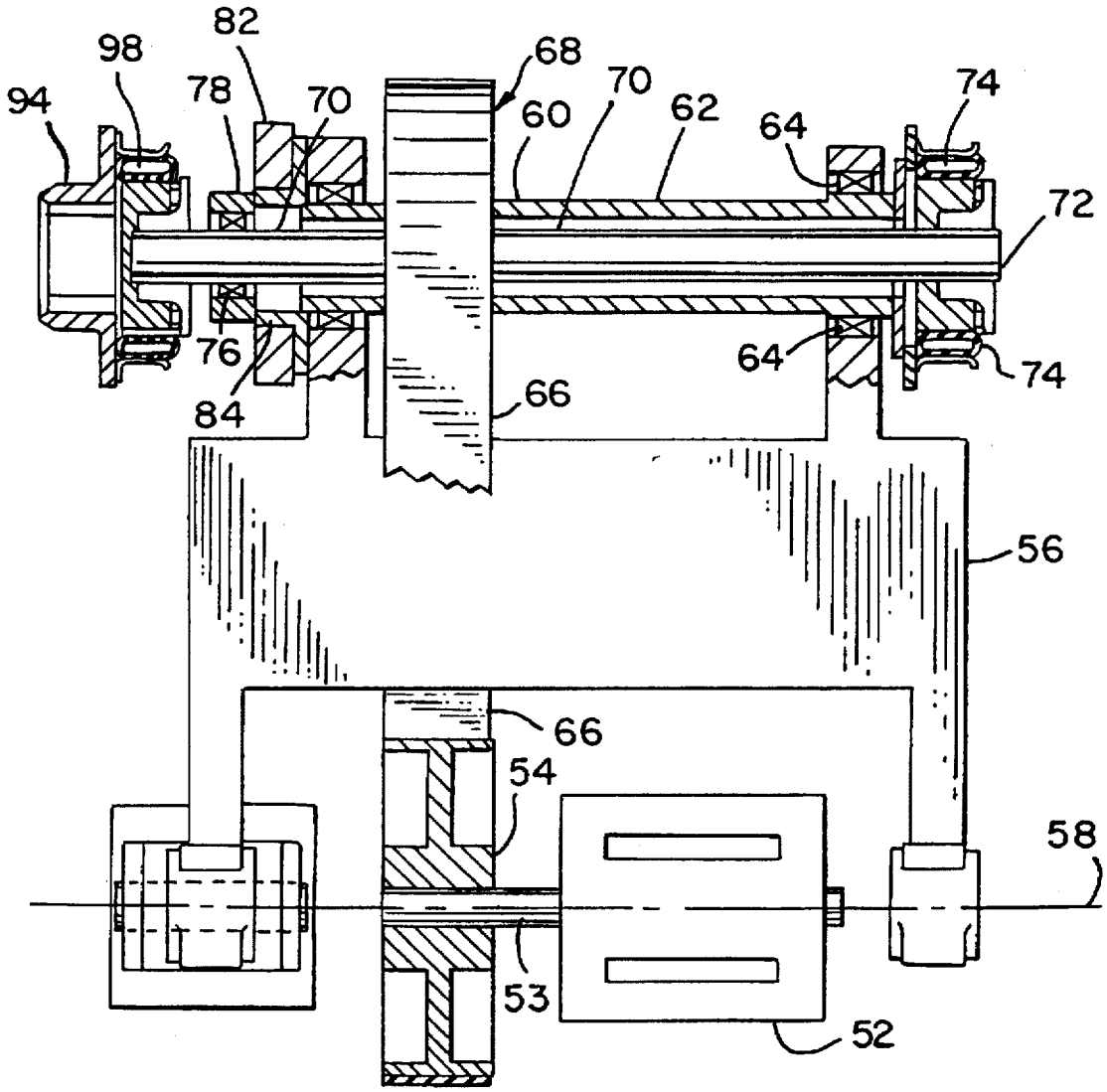
FIG. 3 is a fragmentary cross-sectional view of the centerwind drive shaft and support arm of FIG. 2 taken along section line 3—3.
Figure 4:
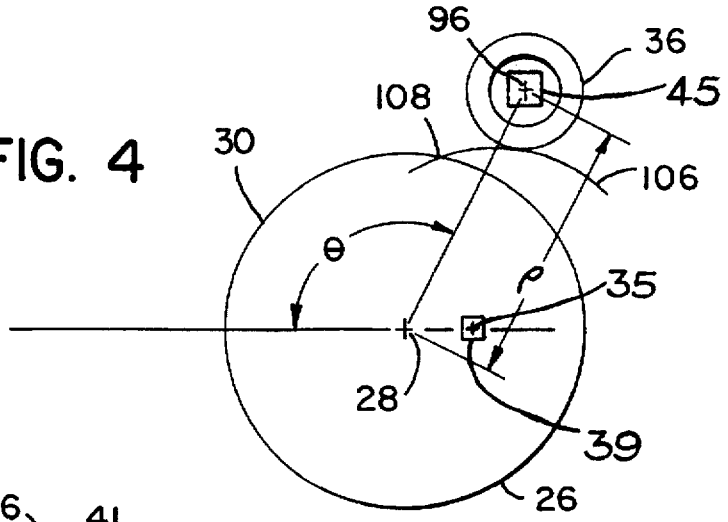
FIG. 4 is a schematic view of the geometric relationship between the spool and the drive roll.

Referring more particularly to FIGS. 1–6 wherein like numbers refer to similar parts, a winder 20 is shown in FIGS. 1 and 2. The winder 20 is part of a papermaking machine and receives a continuous web 37 of paper which has been formed upstream of the winder. The winder 20 has two parallel horizontal support rails 22 which are fixed to a rigid support frame 24. A winder drive roll 26 is rotatably mounted to the support frame 24 about an axis 28 and has a drive surface 30. A first arm 32 has an engagement mechanism 34 which receives and retains spools 36 on which a paper reel 41 is wound from a web 37. The spools 36 are supplied from a conventional spool supply mechanism (not shown) to the engagement mechanism 34. As shown in FIG. 4, the arm 32 moves the spool 36 along an arc which brings the spool into engagement with the surface 30 of the drive roll 26.

A centerwind assist drive or system 38 is mounted for motion on a frame 40. The frame 40 is spaced outwardly of one or both sides of the spool travel rails 22. The centerwind assist 38 is supported on a first carriage 42. The first carriage 42 is mounted for sideward motion on a series of parallel linear guide bearings 44 which extend in a cross-machine direction. The cross-machine linear guide rails 44 are fixed to a second carriage 46 which moves in the machine direction on linear guide rails 48 which extend in a machine direction parallel to the support rails 22. The centerwind assist drive 38 is thus mounted for travel in the machine direction, to move in consort with a traveling spool, and also can be moved in a cross-machine direction for engagement and disengagement from a spool.

As shown in FIG. 2, the centerwind assist drive 38 is configured to position and drive a spool coupling 94 mounted on a rotatable shaft with respect to a spool which is being wound with the web. The centerwind assist 38 has a motor 50 which is mounted to the first carriage 42. The motor 50 drives a gear box 52, shown in FIG. 3, which has an output shaft 53 which drives a first pulley 54 mounted thereon. A drive shaft support arm 56 is pivotably mounted about a lower pivot axis 58 which is concentric with the output shaft 53 axis. The arm 56 supports a spool drive shaft 60 which is parallel to the output shaft 53.

The spool drive shaft 60 is of compound construction, and consists of an outer tubular hollow shaft 62, which is mounted to the arm 56 by support bearings 64, and an inner drive shaft 70 which drives the spool. The outer drive shaft 62 is driven by a looped belt 66 which connects the first pulley 54 on the gear box output shaft 53 to a second pulley 68 mounted on the outer shaft 62.

The inner drive shaft 70 is mounted inside the hollow outer shaft 62 and is connected to the outer drive shaft 62 at the non-spool engaging end 72 by a flexible coupling 74. The flexible coupling 74 is preferably in the form of an inflated bladder or air tube, but may take other equivalent forms. The inner shaft 70 is supported at one end by the flexible coupling 74 and at the other end by an inner shaft bearing 76.

Figure 7:
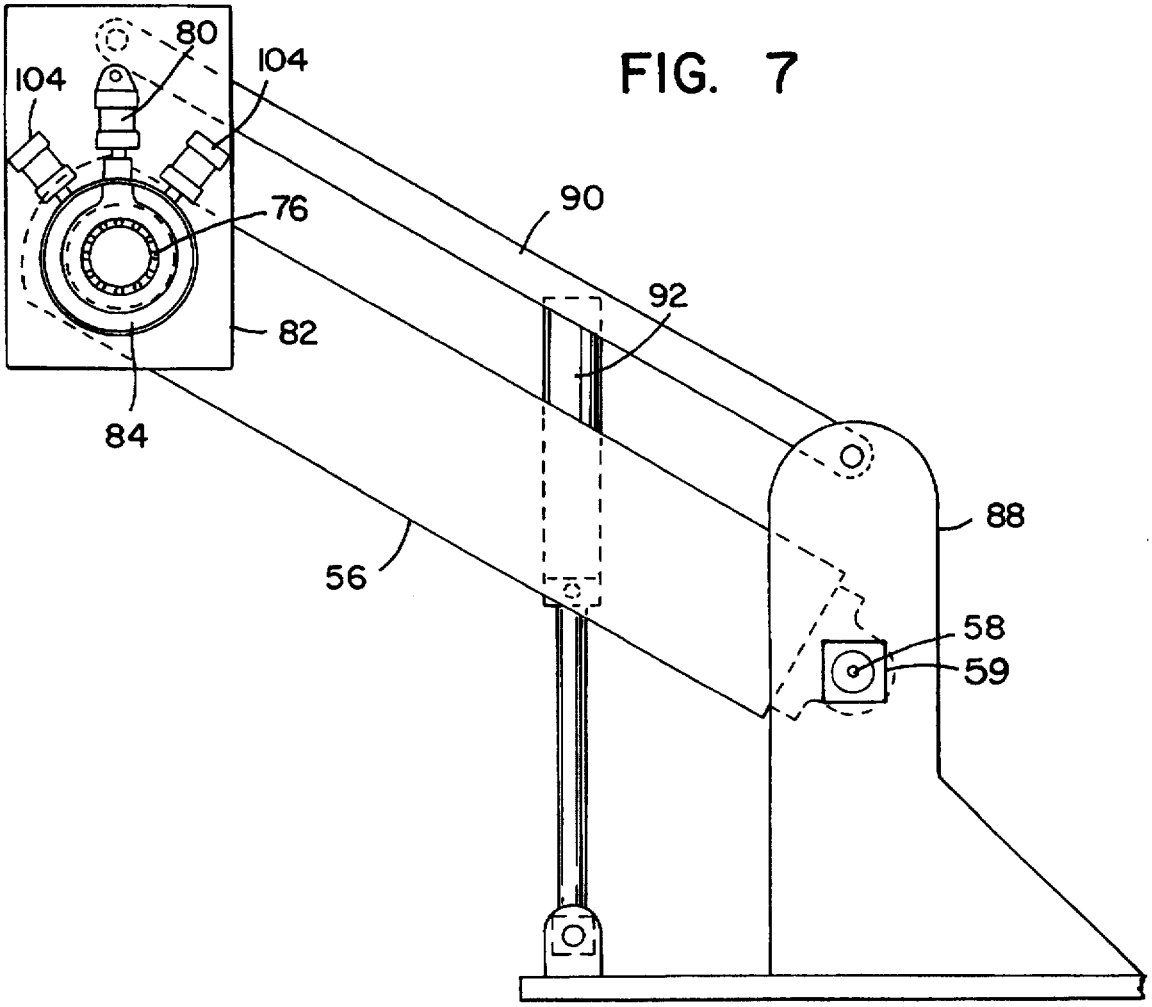
FIG. 7 is a fragmentary side-elevational view of the drive assist and the drive support arm of FIG. 1.

As shown in FIG. 7, the support arm 56 is pivotably connected to a mounting plate 82, which is positioned with respect to the carriage 42 by an actuator 92, such as a hydraulic cylinder. The inner shaft bearing 76 is supported on a shaft ring 78. A drive shaft support cylinder 80 supports the weight of the inner drive shaft by the shaft ring 78. The drive shaft support cylinder 80 is pivotably connected to the mounting plate 82. The mounting plate 82 is pivotably mounted to the drive arm 56 by a support ring 84. The mounting plate 82 is connected to the base 88 by a parallel linkage, and hence retains its orientation with respect to the base as it is elevated and lowered. The arm 56 pivots on the arm pivot 58 of the arm base 88 below a link arm 90 which joins, in parallel fashion, the mounting plate 82 to the arm base 88. The arm 56 is elevated and lowered by the actuator 92. Hence the arm actuator 92 moves the spool drive shaft 60 to position a spool engaging coupling 94 in a vertical plane or in the z-direction relative to the paper web 37 being wound onto the spool 36.

The spool coupling 94 is joined to the end of the inner drive shaft 70 by a second flexible coupling 98. The second carriage 46 is moved along the guide rails 48 and is controlled by a machine direction actuator 100 to position the spool coupling 94 in the machine direction. The spool coupling 94 is moved into and out of engagement with the spool 36 by driving the first carriage 42 in a cross-machine direction with a cross-machine actuator 102.

The paper web 37 formed on a papermaking machine is typically formed at a rate of two thousand to four thousand feet per minute, and may be formed at up to six thousand or more feet per minute. This web is continuously being formed and wound into rolls of paper 41 on spools 36. The process of winding a roll begins with a spool supply system delivering a spool to the engagement mechanism 34 of the first arm 32. Engagement of a spool 36 with the engagement mechanism 34 is positively detected by the actuation of limit switches 33 which are mounted to the arm 32 and are actuated when a spool 36 is properly positioned in the engagement mechanism 34. The engagement of the spool 36 with the engagement mechanism 34 thus positions the spool end 96 at a fixed position with respect to a reference frame defined by the winder 20.

In connecting the spool coupling 94 with the spool end 96 in the engagement mechanism 34, the position of the spool coupling must be known. The spool coupling 94 is put into a known position by extending two centering cylinders 104 from the plate 82 to push against the support ring 84 and thereby bring the spool coupling 94 to a centered position which is known with respect to the winder coordinate system.

The spool coupling 94 is brought into engagement with the spool end 96 by operating actuator 92 to raise the arm 56 until the spool coupling 94 is at the same height as the spool end 96. The machine direction actuator 100 positions the second carriage 46 such that the spool coupling 94 is aligned with the spool end 96 in the machine direction. The cross-machine actuator 102 then moves the first carriage 42 towards the spool end 96 to engage it (i.e., the spool end) with the spool coupling 94.

Once the spool coupling 94 is engaged with the spool 36, the centering cylinders 104 are retracted, thereby allowing the spool coupling 94 to float. This floating of the spool coupling 94 accommodates small misalignments between the outer drive shaft 62 and the spool 36. The motor 50 drives the right angle gear reduction box 52 to drive the belt 66 engaged between the first pulley 54 and the second pulley 68 to drive the outer drive shaft 62.

The outer drive shaft 62 is connected to the inner drive shaft by the flexible coupling 74, such as an air-filled elastic bladder or a constant velocity joint.

The second flexible coupling 98 located between the inner shaft 70 and the spool coupling 94 may be of similar or identical construction to the first flexible coupling 74 and provides for alignment of the spool coupling 94 with the spool end 96. The positioning of the spool coupling 94 and the spool drive shaft 60 is controlled by a controller, microprocessor, or general purpose computer 99 which serves the arm actuator 92 and the machine direction actuator 100 and cross-machine direction actuator 102 to position the spool coupling 94 at the known or calculated location of the spool end 96. While the positioning of the spool drive shaft 60 could be performed open looped, it will generally be advantageous to provide angular measuring sensors, such as a shaft encoder, 59 on the first axis 58 of the arm 56 and linear position transducers 43, 47 on the first and second carriages 42, 46, respectively so that feedback may be used to more accurately position the spool coupling 94.

Historically, Pope-type winders 20, such as generally illustrated in FIGS. 1, 2, and 4–6, have not employed centerwind assist drives or have employed them only after the roll of paper was supported on the support rails 22. It is now known that non-uniformity in the way the paper is wound onto a roll can be a major source of defects in the as-wound condition of the paper roll. Later processing in a rewinder or printing press can result in paper breaks which are traceable to the non-uniformity of the formed paper roll.

It is also now known that three parameters influence wound roll hardness or uniformity: (1) the torque applied to the spool, (2) the linear nip pressure between the wound web roll and the support drum, and (3) the tension in the oncoming web wound into the roll. These parameters are normally controlled in the Pope-type winder by controlling the speed of the winder drive roll 26 in relation to the machine speed of the papermaking machine and controlling the nip pressure by the force with which the first arm 32 and the second arm 51, for clarity shown only in FIG. 6, urge the spool 36 against the winder drive roll 26. These mechanism have been found to be insufficient in some cases particularly with the wider paper widths and larger diameter paper rolls now being formed.

The solution to better roll uniformity is to add a centerwind assist. Recently, a number of completely redesigned winders have been developed to facilitate the use of centerwind assists, as well as generally facilitate the uniform formation of today's modern jumbo paper rolls. In a Pope-type winder, where the first arm positions the spool onto the winder drum and transitions the spool down to rest on the support rails, with the second arm engaging the spool once on the rails and urging it against the winder drum, a non-uniformity of nip pressure can be introduced.

The centerwind assist 38 of this invention employs a system of three degrees of freedom which can engage and track the spool end 96. In order to track the spool end 96, it is necessary to know its position so that the centerwind assist drive 38 may continuously remain engaged and in driving relation. The path taken by the spool end 96 is constrained by geometric considerations as roll of paper 41 is wound onto the spool 36.

Figure 5:
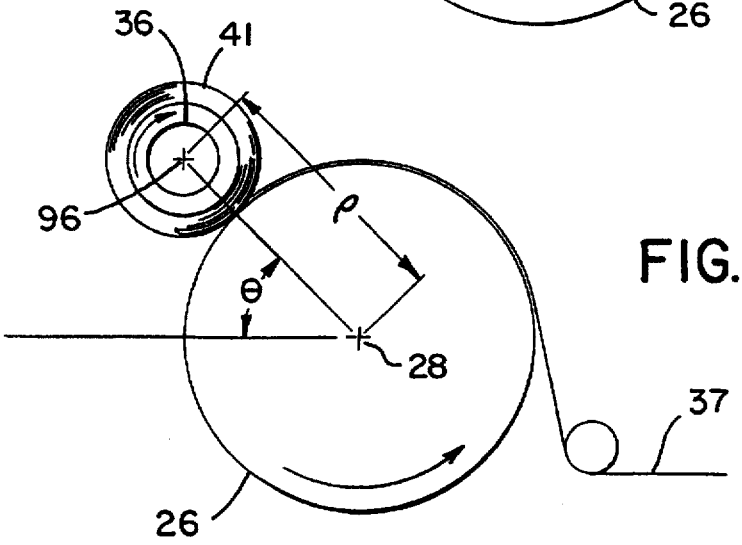
FIG. 5 is a schematic view of the spool engaged on the drive roll.
Figure 6:
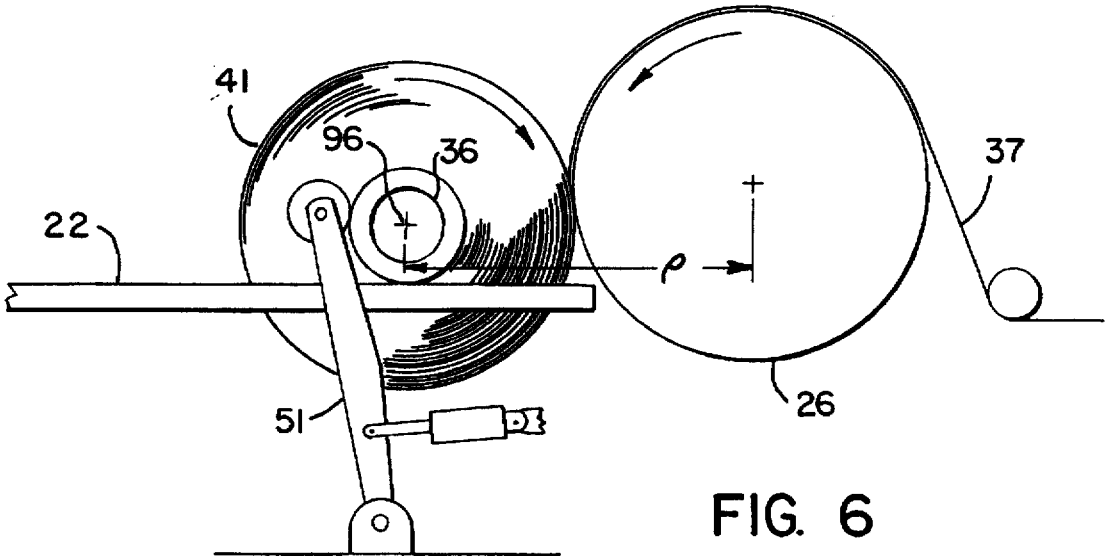
FIG. 6 is a schematic view of the spool engaged on the support rails.

FIGS. 4, 5 and 6 illustrate three distinct phases of the process of forming a paper roll 41 on the spool 36 during which different geometric parameters determine the position of the spool end 96. As shown in FIG. 4, the spool 36 starts at an initial position where it is engaged with the engagement mechanism of the first arm 32, and is rotated along a curved path 106 defined by the rotation of the first arm 32 about its pivot axis 35, which is offset from the axis of revolution of drive roll 26. The curved path 106 intersects the surface 30 of the drive roll 26 at a point 108 referred to as the top dead center of the drive roll 26.

As shown in FIG. 1, the position of the axis or center of the spool end 96, with respect to the axis 28 of the drive roll 26, may be defined in polar coordinates in terms of $\theta$ and $\rho$. The angle between the horizontal and the line connecting the axis 28 of the drive roll 26 with the center of the spool end 96 is defined as $\theta$, and the distance between the two axes defines $\rho$. Theta and rho ($\theta$) and ($\rho$) can be determined by an angular transducer sensor 39 mounted on the pivot 35 of the first arm 32. A simple coordinate transformation translates the angular position of the first arm into $\rho,\theta$ coordinates.

Once the spool 36 engages the surface 30 of the drive roll 26 at the top dead center point 108, the paper turn-up mechanism (not shown) initiates the wrap of the paper web about the spool 36 and separates the paper web from the formed paper roll 41. As shown in FIG. 5, while the spool 36 is still retained by the first arm 32, $\theta$ is derivable from the angular sensor 39 on the first arm, however, once paper has begun to be wound on the spool, $\rho$ is dependent upon the radius of the drive roll 26 and the combined radius of the spool and the paper roll formed thereon.

The radius of the drive roll 26 is fixed and known, and the radius of the paper roll 41 may be derived from an angular velocity sensor 45 which determines the angular velocity or rate of rotation of the inner drive shaft 70. Because the paper roll 41 and the drive roll 26 are in driving engagement, the ratio of their angular velocities must be the ratio between their respective radii. Thus, the angular velocity sensor 45 on the inner drive shaft (i.e., paper roll 41) and the angular sensor 31 on the first arm 32, together with the measured angular velocity, by angular velocity sensor 49, of the drive roll 26 and its known fixed diameter, determines the location of the spool end 96.

As shown in FIG. 6, a third geometric relation obtains where the spool is no longer positioned by the first arm 32, but is instead riding on the parallel rails 32 and is urged against the drive drum 26 by the second arm 51. The coordinates of the spool end 96 are determined by the fixed height of the spool center above the support rails 22, and the spool and paper radius which is again determined by the relevant angular velocities between the drive drum 26 and the paper roll 41 with $\rho$ in FIG. 6 being equal to the sum of the radii of the paper roll 41 and the drive roll 26. The drive roll has a fixed radius and the paper roll 41 has a radius which is determinable from the angular velocity of the paper roll 41 as detected by a sensor on the inner shaft 70 in relation to the angular velocity of the drive roll 26.

A microprocessor can employ the three geometric relationships shown in FIGS. 4–6 together with sensors which measure the angular position of the first arm, the angular velocities of the drive roll 26 and the spool 36, together with the known diameter of the drive roll and the position of the support rails, to constantly determine the position of the spool end 96 and thus serve the centerwind assist system to maintain the spool coupling 94 and engagement with the spool end 96.

It will, thus, be seen that the apparatus 20 provides centerwind assist to the spool 36 throughout its complete travel from its first engagement on the first arm, through its travel along the drive roll and onto the parallel rails. The various angular velocity sensors and angular position sensors allow the centerwind drive assist to track with the motion of the spool and apply appropriate centerwind drive assistance.

It should be understood that where hydraulic cylinders are described, ball and screw actuators, timing belts, pneumatic or linear gear drives and other similar systems could be employed. One important feature of the centerwind assist drive 38 is the prevention of any unsymmetrical loads which might detrimentally influence the uniformity of the wind on the roll of paper formed. The use of the drive shaft support cylinder to support the weight of the drive shaft 70 and the spool coupling 94 has the benefit that it prevents the weight of the drive shaft from resting on the spool end 96.

Because the winding of paper is a continuous process it may be desirable to have two centerwind assist systems 38, one located on each side of the winder 20 so that a first arm may engage a spool 36 while it is being spun up to speed in the first arm 32, while at the same time, a centerwind assist system 38 may be completing the winding of a paper roll 41 which is being supported on the support rails 22. Alternatively, because tension in the outer wraps paper is less critical, it may be possible to use the centerwind assist drive until just before the paper roll 41 is complete and then disconnect and move a single centerwind assist towards the winder roll to engage the next spool in the first support arm.

It should also be understood that the position of the spool on the roll of formed paper when it is residing on the support rails 22 may be determined by the angular position of the second arm, though perhaps with some loss of accuracy.

In addition, although only a single first arm and second arm have been illustrated, it should be understood that normally, the first and second arms will consist of a pair of arms, one on each side of the apparatus.

It should further be understood that in typical existing reels, centerwind assist drives have been used only while the roll builds on the horizontal linear rails, after several centimeters of web have built up on the spool. In order to optimize the structure of the wound roll, torque must be provided continuously to the spool from the beginning of the winding operation. Further, in some applications such as when reeling creped or carbonless copy paper grades, low level nip pressures must be provided to prevent damage to the paper product. On conventional Pope-type reels not having centerwind torque, the low nip pressure required to prevent damage to the creped and carbonless paper does not provide enough friction to drive the web roll being wound. Thus, it should be understood that the centerwind assist system 38 is capable of providing consistent centerwind assist to new and existing Pope style winders from the moment the paper web is formed onto the spool.

It is understood that the invention is not limited to the particular construction and arrangement of parts herein illustrated and described, but embraces such modified forms thereof as come within the scope of the following claims.

I claim:

1. A method for providing centerwind assist on a winder of the type having a drive roll with an axis, and support rails for receiving and supporting a spool on which a paper roll is wound, the rails being substantially horizontal and at a level which approximately coincides with the axis of the winder drum, the method comprising the steps of:

detecting the engagement of a winder spool with a first arm, the spool having an axis of rotation and at least one end;

engaging a centerwind assist drive with the end of the spool while the spool is mounted on the first arm;

moving the first arm until the spool comes in contact with the rails, and measuring the rotation angle of the moving first arm with respect to a reference position;

measuring the angular velocity of the spool while a paper web is being wound thereon;

determining the position and path of the spool axis and said at least one end of the spool from the time it is loaded into the first arm until a complete roll of paper is wound thereon by use of a controller employing the measured rotation angle, the measured angular velocity of the spool, a known position for the rails, and a known radius and angular velocity for the drive roll; and controlling the position of the centerwind assist drive in response to the determined path and position of the spool axis and spool end so that the centerwind assist is engaged continuously with the spool during the reel winding process.

2. The method of claim 1 further comprising the step of using a second arm to retain the forming paper roll against the winder drum when the spool is positioned on the rails.

3. The method of claim 1 wherein the step of engaging a centerwind assist drive with the end of the spool comprises the steps of moving the centerwind assist drive on an arm which is pivotally mounted to a carriage, and moving the carriage in a machine direction and a cross-machine direction.

4. The method of claim 1 wherein the step of engaging a centerwind assist drive with the end of the spool comprises the steps of elastically engaging an inner shaft which has a first spool engaging end with an outer shaft and driving the outer shaft.

5. The method of claim 1 wherein the step of engaging the centerwind assist drive with the end of the spool further includes the step of:

providing motion in a cross-machine direction to thereby engage and disengage the drive shaft with the spool.

6. A centerwind assist drive for use with a paper winder comprising:

a means for determining the position of an axial end of a spool as the spool traverses a path on a winding machine as a roll of paper is formed on the spool;

a rotatable drive shaft; and a means for positioning the drive shaft in response to the position determining means so that the drive shaft engages with the spool as the spool moves in the paper winder having a paper roll wound thereon.

7. The apparatus of claim 6 wherein the means for positioning the drive shaft comprises:

a carriage mounted for motion in a machine direction;

a motor mounted to the carriage;

a gearbox which is driven by the motor;

an output shaft extending from the gearbox and operatively linked with the drive shaft, wherein the drive shaft is driven by the gearbox output; and an arm to which the drive shaft is rotatably mounted, wherein the arm is pivotably mounted to the carriage, and wherein the arm supports the shaft approximately parallel to the axis of rotation of the winder spool, and wherein the pivotal motion of the arm in combination with the machine direction motion of the carriage positions the shaft approximately coaxial with the axis of the spool.

8. The apparatus of claim 6 further comprising a means for positioning the drive shaft in a cross-machine direction so the drive shaft can be engaged and disengaged with the spool in driving relationship.

9. The apparatus of claim 6 wherein the centerwind assist is mounted to a paper winder comprising:

a drive roll having an axis of rotation and a drive surface;

a frame, fixed with respect to the drive roll;

a first arm pivotally mounted to the frame, the first arm having a mechanism for receiving spools at a position above the surface of the drive roll, wherein the first arm is pivotable to bring a spool from a first engagement position above the drive roll into engagement with the drive roll at a first position; and a pair of parallel, substantially horizontal rails positioned to receive a roll of paper formed on a spool while the spool is in engagement with the drive roll, the rails positioned substantially below the first engagement position, wherein the position determining means includes a linear positioning means for positioning a spool along the rails, the linear positioning means having an output for signaling the location of a spool along the rails and, an angular sensor for measuring the angular position of the first arm, and a microprocessor employing the output of the linear positioning means and the angular sensor to determine the position of the axial end of the spool.

10. A winder for use with a papermaking machine, the winder comprising:

a winder drive roll rotatable about an axis;

a first arm having an engagement mechanism for receiving a spool, wherein the first arm is pivotally mounted with respect to the drive roll so the spool engaged by the engagement mechanism may be rotated into engagement with the winder drive roll at a first position vertically displaced upwardly of the axis of the drive roll;

at least two rails positioned to receive a spool in engagement with the drive roll, wherein the rails are positioned below the first position;

a second arm pivotally mounted for urging a spool and a roll of paper formed thereon against the drive roll when the spool is resting on the rails;

a carriage mounted for motion in a machine direction defined by the papermaking machine; and a means for providing torque to the spool throughout its travel from the first position and along the rails, wherein the means is mounted to the carriage.

11. The apparatus of claim 10 further comprising a carriage mounted for movement in a cross-machine direction and mounted to the carriage mounted for motion in a machine direction so as to provide cross-machine motion to the means for providing torque, to couple and uncouple the means for providing torque from the spool.

12. A device for winding a paper web onto a spool, the device comprising:

a frame;

a drive roll rotatably mounted to the frame about an axis;

a first arm mounted to the frame to pivot with respect to the drive roll;

an engagement mechanism on the first arm which receives and releasably engages the spool onto which a paper web is to be wound, the engaged spool being movable on the first arm to retain the spool in engagement with the drive roll as paper is wound on the spool as the spool travels from a first position above the drive roll axis;

at least two rails positioned to receive the spool in engagement with the drive roll, wherein the rails are positioned below the first position and extend downstream of the drive roll; and a centerwind assist drive means for rotating the spool, wherein the centerwind assist drive means is positionably mounted to the frame, and wherein the centerwind assist drive means provides torque to the spool throughout its travel from the first position to a position supported on the drive roll, to a position traveling along the rails;

a first carriage mounted to the frame for motion in a cross-machine direction; and a second carriage mounted to the first frame for motion in a machine direction toward and away from the drive roll, wherein the first and second carriages are connected into an assembly, and the centerwind assist drive means is mounted to the assembly for motion in both a machine direction and a cross-machine direction.

13. A device for winding a paper web onto a spool, the device comprising:

a frame;

a drive roll rotatably mounted to the frame about an axis;

a first arm mounted to the frame to pivot with respect to the drive roll;

an engagement mechanism on the first arm which receives and releasably engages the spool onto which a paper web is to be wound, the engaged spool being movable on the first arm to retain the spool in engagement with the drive roll as paper is wound on the spool as the spool travels from a first position above the drive roll axis:

at least two rails positioned to receive the spool in engagement with the drive roll, wherein the rails are positioned below the first position and extend downstream of the drive roll; and a centerwind assist drive means for rotating the spool, wherein the centerwind assist drive means is positionably mounted to the frame, and wherein the centerwind assist drive means provides torque to the spool throughout its travel from the first position to a position supported on the drive roll, to a position traveling along the rails;

a first carriage mounted to the frame for motion in a cross-machine direction;

a second carriage mounted to the first frame for motion in a machine direction toward and away from the drive roll, wherein the first and second carriages are connected into an assembly, and the centerwind assist drive means is mounted to the assembly for motion in both a machine direction and a cross-machine direction;

an assist support arm pivotably mounted to the assembly, wherein the centerwind assist drive means is mounted to the assist support arm.

14. A device for winding a paper web onto a spool, wherein the centerwind assist drive means includes a drive shaft, and further comprising:

a frame;

a drive roll rotatably mounted to the frame about an axis;

a first arm mounted to the frame to pivot with respect to the drive roll;

an engagement mechanism on the first arm which receives and releasably engages the spool onto which a paper web is to be wound, the engaged spool being movable on the first arm to retain the spool in engagement with the drive roll as paper is wound on the spool as the spool travels from a first position above the drive roll axis;

at least two rails positioned to receive the spool in engagement with the drive roll, wherein the rails are positioned below the first position and extend downstream of the drive roll; and a centerwind assist drive means for rotating the spool, wherein the centerwind assist drive means is positionably mounted to the frame, and wherein the centerwind assist drive means provides torque to the spool throughout its travel from the first position to a position supported on the drive roll, to a position traveling along the rails;

a first carriage mounted to the frame for motion in a cross-machine direction;

a second carriage mounted to the first frame for motion in a machine direction toward and away from the drive roll, wherein the first and second carriages are connected into an assembly, and the centerwind assist drive means is mounted to the assembly for motion in both a machine direction and a cross-machine direction;

wherein the centerwind assist drive means includes a drive shaft, and further comprising a support plate;

a lower arm extending from the carriage assembly to the support plate, and pivotably mounted to both the carriage assembly and the support plate;

an upper arm extending from the carriage assembly to the support plate, and pivotably mounted to both the carriage assembly and the support plate; and an actuator which extends between the carriage assembly and the upper arm and the lower arm to move the mounting plate along a path which retains the orientation of the mounting plate with respect to the axis of the drive shaft as the carriage assembly moves in the machine direction.

15. A device for winding a paper web onto a spool, comprising:

a frame;

a drive roll rotatably mounted to the frame about an axis;

a first arm mounted to the frame to pivot with respect to the drive roll;

an engagement mechanism on the first arm which receives and releasably engages the spool onto which a paper web is to be wound, the engaged spool being movable on the first arm to retain the spool in engagement with the drive roll as paper is wound on the spool as the spool travels from a first position above the drive roll axis;

at least two rails positioned to receive the spool in engagement with the drive roll, wherein the rails are positioned below the first position and extend downstream of the drive roll; and a centerwind assist drive means for rotating the spool, wherein the centerwind assist drive means is positionably mounted to the frame, and wherein the centerwind assist drive means provides torque to the spool throughout its travel from the first position to a position supported on the drive roll, to a position traveling along the rails;

a first carriage mounted to the frame for motion in a cross-machine direction;

a second carriage mounted to the first frame for motion in a machine direction toward and away from the drive roll, wherein the first and second carriages are connected into an assembly, and the centerwind assist drive means is mounted to the assembly for motion in both a machine direction and a cross-machine direction;

an assist support arm pivotably mounted to the assembly, wherein the centerwind assist drive means is mounted to the assist support arm; and further comprising a support plate;

a lower arm extending from the carriage assembly to the support plate, and pivotably mounted to both the carriage assembly and the support plate;

an upper arm extending from the carriage assembly to the support plate, and pivotably mounted to both the carriage assembly and the support plate; and an actuator which extends between the carriage assembly and the upper arm and the lower arm to move the mounting plate along a path which retains the orientation of the mounting plate with respect to the axis of the drive shaft as the carriage assembly moves in the machine direction;

a support actuator pivotably mounted to the support plate; and a bearing which engages the drive shaft, wherein the support actuator extends between the support plate and the bearing to support the weight of the drive shaft.

16. A device for winding a paper web onto a spool, the device comprising:

a frame;

a drive roll rotatably mounted to the frame about an axis;

a first arm mounted to the frame to pivot with respect to the drive roll;

an engagement mechanism on the first arm which receives and releasably engages the spool onto which a paper web is to be wound, the engaged spool being movable on the first arm to retain the spool in engagement with the drive roll as paper is wound on the spool as the spool travels from a first position above the drive roll axis;

at least two rails positioned to receive the spool in engagement with the drive roll, wherein the rails are positioned below the first position and extend downstream of the drive roll; and a centerwind assist drive means for rotating the spool, wherein the centerwind assist drive means is positionably mounted to the frame, and wherein the centerwind assist drive means provides torque to the spool throughout its travel from the first position to a position supported on the drive roll, to position traveling along the rails;

a first carriage mounted to the frame for motion in a cross-machine direction; and a second carriage mounted to the first frame for motion in a machine direction toward and away from the drive roll, wherein the first and second carriages are connected into an assembly, and the centerwind assist drive means is mounted to the assembly for motion in both a machine direction and a cross-machine direction;

centerwind assist drive means includes a drive shaft; and further comprising a support plate;

a lower arm extending from the carriage assembly to the support plate, and pivotably mounted to both the carriage assembly and the support plate;

an upper arm extending from the carriage assembly to the support plate, and pivotably mounted to both the carriage assembly and the support plate; and an actuator which extends between the carriage assembly and the upper arm and the lower arm to move the mounting plate along a path which retains the orientation of the mounting plate with respect to the axis of the drive shaft as the carriage assembly moves in the machine direction;

a support actuator pivotably mounted to the support plate; and a bearing which engages the drive shaft, wherein the support actuator extends between the support plate and the bearing to support the weight of the drive shaft; and further comprising two positioning actuators which extend from the support plate and which engage against the drive shaft, wherein the positioning actuators are extendible to position the drive shaft in a known position.

17. A device for winding a paper web onto a spool, the device comprising:

a frame;

a drive roll rotatably mounted to the frame about an axis;

a first arm mounted to the frame to pivot with respect to the drive roll;

an engagement mechanism on the first arm which receives and releasably engages the spool onto which a paper web is to be wound, the engaged spool being movable on the first arm to retain the spool in engagement with the drive roll as paper is wound on the spool as the spool travels from a first position above the drive roll axis;

at least two rails positioned to receive the spool in engagement with the drive roll, wherein the rails are positioned below the first position and extend downstream of the drive roll; and a centerwind assist drive means for rotating the spool, wherein the centerwind assist drive means is positionably mounted to the frame, and wherein the centerwind assist drive means provides torque to the spool throughout its travel from the first position to a position supported on the drive roll, to a position traveling along the rails;

wherein the centerwind assist drive means comprises a motor;

an inner drive shaft which is engagable with the spool to rotate the spool at a desired rate; and an outer shaft which encircles the inner drive shaft, wherein the outer shaft is driven by the motor, and wherein the inner shaft is resiliently engaged by the outer shaft.

18. A device for winding a paper web onto a spool, the device comprising:

a frame;

a drive roll rotatably mounted to the frame about an axis;

a first arm mounted to the frame to pivot with respect to the drive roll;

an engagement mechanism on the first arm which receives and releasably engages the spool onto which a paper web is to be wound, the engaged spool being movable on the first arm to retain the spool in engagement with the drive roll as paper is wound on the spool as the spool travels from a first position above the drive roll axis;

at least two rails positioned to receive the spool in engagement with the drive roll, wherein the rails are positioned below the first position and extend downstream of the drive roll; and a centerwind assist drive means for rotating the spool, wherein the centerwind assist drive means is positionably mounted to the frame, and wherein the centerwind assist drive means provides torque to the spool throughout its travel from the first position to a position supported on the drive roll, to a position traveling along the rails;

a motor;

an inner drive shaft which is engagable with the spool to rotate the spool at a desired rate; and an outer shaft which encircles the inner drive shaft, wherein the outer shaft is driven by the motor, and wherein the inner shaft is resiliently engaged by the outer shaft; wherein the inner shaft has two ends and the outer shaft has two ends, and wherein two corresponding ends of the inner shaft and the outer shaft are resiliently engaged.

* * * * *